US009776647B2

(12) United States Patent
Dymek et al.

(10) Patent No.: US 9,776,647 B2
(45) Date of Patent: Oct. 3, 2017

(54) INPUT OF ETCS DATA INTO A RAIL VEHICLE

(71) Applicant: SIEMENS AKTIENGESELLSCHAFT, Munich (DE)

(72) Inventors: Markus Dymek, Berlin (DE); Carsten Hasselkuss, Berlin (DE); Udo Rabeneck, Lehrte (DE); Christian Wilke, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/428,427

(22) PCT Filed: Sep. 5, 2013

(86) PCT No.: PCT/EP2013/068328
§ 371 (c)(1),
(2) Date: Mar. 16, 2015

(87) PCT Pub. No.: WO2014/040895
PCT Pub. Date: Mar. 20, 2014

(65) Prior Publication Data

US 2015/0232109 A1 Aug. 20, 2015

(30) Foreign Application Priority Data

Sep. 14, 2012 (DE) ..... 10 2012 216 430

(51) Int. Cl.
*G05D 1/00* (2006.01)
*B61L 15/00* (2006.01)
*B61L 27/00* (2006.01)

(52) U.S. Cl.
CPC ..... *B61L 15/0072* (2013.01); *B61L 27/0038* (2013.01); *B61L 2027/0044* (2013.01)

(58) Field of Classification Search
CPC ..... B61L 15/0072; B61L 27/0038
See application file for complete search history.

(56) References Cited

U.S. PATENT DOCUMENTS 5,803,411 A 9/1998 Ackerman et al.
6,058,168 A 5/2000 Braband
(Continued)

FOREIGN PATENT DOCUMENTS

CH 698679 B1 9/2009
DE 69717763 T2 10/2003
(Continued)

*Primary Examiner* — Adam Alharbi
(74) *Attorney, Agent, or Firm* — Laurence Greenberg; Werner Stemer; Ralph Locher

(57) ABSTRACT

A method for inputting ETCS data into a rail vehicle inputs the ETCS data by using an apparatus which is separate from the rail vehicle. The apparatus can, for example, be constructed to be mobile and the ETCS data can be input flexibly at different locations and be transmitted to the rail vehicle, for example, by SMS. The advantage of this approach is that delays resulting from the inputting of ETCS data can be reduced and thus the rail vehicle reaches a "Start of Mission" state more quickly. An apparatus for inputting ETCS data into a rail vehicle and a rail vehicle with an ETCS device are also provided.

16 Claims, 1 Drawing Sheet

(56) References Cited

U.S. PATENT DOCUMENTS

| | | | | |
|---|---|---|---|---|
| 8,295,993 | B2 * | 10/2012 | Kumar | B61L 3/006 701/100 |
| 2007/0233364 | A1 | 10/2007 | Kumar | |
| 2013/0336367 | A1 * | 12/2013 | Soderi | H04B 1/707 375/144 |
| 2015/0329128 | A1 * | 11/2015 | Porsch | B61L 3/006 701/19 |

FOREIGN PATENT DOCUMENTS

| | | | |
|---|---|---|---|
| DE | 102008045050 | A1 | 3/2010 |
| DE | 102011004840 | A1 | 8/2012 |
| EP | 2371661 | A2 | 10/2011 |
| WO | 9724825 | A2 | 7/1997 |

* cited by examiner

INPUT OF ETCS DATA INTO A RAIL VEHICLE

BACKGROUND OF THE INVENTION

Field of the Invention

The invention relates to a method and an apparatus for inputting ETCS data into a rail vehicle and to a corresponding rail vehicle.

The European Train Control System (abbreviated ETCS) is a component of a standardized European rail traffic management system that was developed under the abbreviation ERTMS. The second technical component of this digital rail technology is the rail mobile radio system GSM-R. ETCS is intended to replace the variety of individual train protection systems in use in the different countries.

ETCS carries out several functions. It monitors the local maximum speed, the maximum speed of the train, the correct route of the train, the direction of travel, the suitability of the train for the route and the maintaining of specific operational regulations.

These items of information are processed by the modules of the ETCS:

- lineside, the Eurobalise beacons or Euroloops installed trackside for ETCS Level 1, and with ETCS Level 2 and 3, the RBC (Radio Block Centre) connected to the switch tower,
- on the vehicle side the ETCS Onboard Unit (OBU) that processes the received data, displays it to the traction vehicle driver and automatically halts the train before a danger point in the case of danger.

The ETCS vehicle device consists principally of an ETCS computer (also called EVC—European Vital Computer), a DMI (Driver Machine Interface) display, position sensor, GSM-R data carrier (including Euroradio), balise reader and access to the brakes.

In addition to the ETCS levels, ETCS modes are defined. The modes describe the states in which the EVC can be. An overview is available, for example in the ETCS vehicle device of a vehicle requires, in the context of a "Start Of Mission" (the start of a journey of the rail vehicle), the inputting of train data and the selection of a Level and a Mode. This input of data is done by a traction vehicle driver using the interface provided for this purpose (the DMI: Driver Machine Interface) installed in the driver cab of the rail vehicle. This inputting of data requires a certain time duration and can be done only on the rail vehicle itself.

This results in the disadvantage that through manual inputting at the location, in other words at the DMI interface in the driver cab of the rail vehicle, time is lost, which can sometimes also result in delays in the train schedule.

BRIEF SUMMARY OF THE INVENTION

The object of the invention consists in the avoidance of the disadvantage stated above and in particular the creation of an efficient and time-saving approach of acquiring the required data before the train journey.

This object is achieved in accordance with the features of the independent claims. Preferred embodiments can be taken from the dependent claims in particular.

To achieve the object a method is proposed for the input of ETCS data into a rail vehicle,

- in which the ETCS data is captured by a unit,
- in which the ETCS data is transmitted from the unit to the rail vehicle.

The ETCS data is data that is intended for the ETCS vehicle device of the rail vehicle and can be used by the rail vehicle. It includes in particular such data as is to be transmitted to the rail vehicle before the start of a rail journey.

This suggestion thereby creates a possibility of inputting ETCS data that requires fewer operator actions by the traction vehicle driver on-site on the rail vehicle and can therefore be carried out more quickly. The rail vehicle is thereby more quickly ready to complete the next journey.

It should be noted here that the rail vehicle (also referred to as "train") has at least one carriage, which carriage can be a traction vehicle, a passenger car, a freight car or a combination of such compartments or functions. The traction vehicle has a driver cab (also called operator station) and can be implemented powered or unpowered. The traction vehicle can in particular be a locomotive.

It is a development that the ETCS data includes at least one of the following items of information:

- train data,
- an ETCS Level,
- an ETCS Mode.

It is another development that the train data includes at least one of the following items of information:

- a maximum speed of the rail vehicle,
- a length of the rail vehicle,
- a brake power of the rail vehicle.

In particular it is a development that the unit is a portable unit, in particular a mobile computer, a tablet PC or a smartphone.

It is also a development that the unit is a stationary computer, in particular an operating terminal.

In addition is it a development that the ETCS data is transmitted to the rail vehicle by means of at least one message, in particular an SMS message.

In this matter is can be advantageous that the SMS message is received by a GSM-R module of the rail vehicle and is appropriately evaluated and implemented in the rail vehicle.

In the context of a further development it is an option that the at least one message has a sender identifier and/or a destination identifier.

Using the sender identifier, the source of the message can be determined and, if appropriate, (automatically) checked. Optionally, using the destination identifier, it can be checked whether the data was transmitted to the correct rail vehicle.

Both the sender identifier and the destination identifier can be encrypted or encoded to avoid inputting fake or erroneous messages. By way of example, symmetric and/or asymmetric cryptographic mechanisms can be used in this.

A subsequent development is that the sender identifier is a telephone number wherein the valid sender identifiers are stored in the rail vehicle and wherein the stored sender identifiers are used in checking whether the sender identifier of a message is valid.

This enables it to be achieved that only valid sender identifiers are accepted. Optionally a warning can be issued or transmitted to a center if an invalid sender identifier was ascertained.

One embodiment is that the unit transmits the ETCS data to the rail vehicle via a wireless interface or via a wired interface or a combination of both interfaces.

The transmission can, for example, take place wirelessly through a radio interface, in particular through a mobile (tele-)communications interface (e.g. 2G, 3G, LTE, etc.).

One alternative embodiment consists in the ETCS data being transmitted, at least in part, from the unit through a center to the rail vehicle.

By way of example, the center also carries out a plausibility check on the transmitted data and/or the data is complemented before it is passed on to the rail vehicle.

A subsequent embodiment is that the transmitted ETCS data is displayed on an input terminal of the rail vehicle as preselected data.

It is also an embodiment that the data displayed as preselected data is accepted in the rail vehicle as soon as it has been at least partially confirmed.

A development consists in the confirmation of the data being a prerequisite for the ability of the rail vehicle to carry out the next journey.

An additional embodiment is that the ETCS data is determined at least partially automatically from dispositive data from the vehicle operation and transmitted to the rail vehicle.

The above embodiments are applicable as appropriate for the further claim categories.

The object stated above is also achieved by an apparatus for inputting ETCS data into a rail vehicle, with an input device by the use of which the ETCS data can be captured, with a transmission device for transmitting the input ETCS data to the rail vehicle.

In addition the object stated above is achieved by means of a rail vehicle with an ETCS device that is configured such that ETCS data captured by a unit can be received and the received ETCS data for adjustment of the ETCS device is accepted or displayed as suggested values for adjustment of the ETCS device.

The solution presented here includes in addition a computer program product that can be directly loaded into the memory of a digital computer, including program code sections that are suitable for carrying out steps of the method described here.

In addition the problem stated above is solved by means of a computer-readable storage medium, e.g. any selected memory, containing instructions that can be executed by a computer (e.g. in the form of program code) and which are appropriate for the computer to perform steps of the method described here.

The properties, features and advantages of this invention described above, and the manner in which they are achieved become clearer and more precisely understandable in conjunction with the following schematic description of exemplary embodiments that are explained in more detail in conjunction with the drawings. For clarity, equal elements or elements with equal effects can be given the same reference signs.

DESCRIPTION OF THE INVENTION

Figure 1:
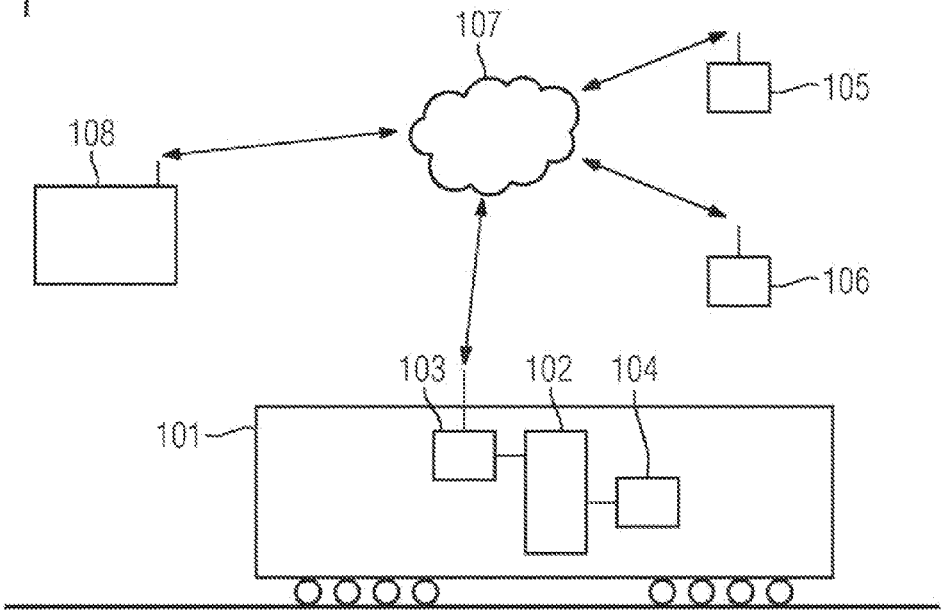
FIG. 1 an exemplary scenario with a rail vehicle with an ETCS device.

A possibility of inputting ETCS train data with a selection of Level and Mode is created, that requires fewer operator actions of the traction vehicle driver on-site on the rail vehicle and can therefore be carried out in a shorter time.

For this it is suggested that the train data to be input, the Level and/or Mode be input into a unit (e.g. a computer or a terminal), in particular a portable unit (e.g. a portable handheld unit, a cellular telephone, a smartphone, a tablet PC, a notebook etc.) and transmitted by this via a wireless or wired interface, in particular a radio interface of a telecommunications network (e.g. by use of the Short Message Service SMS) to the ETCS vehicle device. Preferably the (portable) unit incorporates for this purpose a suitable interface to the wired or wireless network, so that the inputs, e.g. in the form of at least one message, can be transmitted. It should be noted here that there also exist stationary units that can send a message, e.g. an SMS, via a wired or wireless interface, e.g. a connection to the Internet, to the ETCS vehicle device.

By way of example the unit, in particular in the form of a portable handheld unit, can be operated by a user, e.g. a traction vehicle driver, a shunter, a dispatcher etc.

The message, in particular the SMS, can be received by a GSM-R module of the ETCS vehicle device. The SMS can correspondingly be processed in a processing unit of the rail vehicle. By way of example, train data, Level and Mode can be extracted from the message and transmitted to the DMI.

In place of the GSM-R module, a separate GSM unit or an existing train radio unit (that is, for example, SMS-capable) can be used.

Train data, Level and Mode are displayed on the DMI by way of example as suggested values that the user, in particular the traction vehicle driver, can confirm. Through the confirmation the safety-related input continues to lie in the sphere of the ETCS vehicle device or with the actual input of train data.

In addition the message can have a sender identifier that can be displayed to inform the user, e.g. the traction vehicle driver, about the source of the data. Optionally a receiver identifier (e.g. a train number) can be displayed to show the destination of the data to the user so that the latter can quickly determine that it is the correct data for the current rail vehicle.

For the avoidance of receiving incorrect messages the valid sender telephone numbers or the valid sender identifiers can be stored in the ETCS vehicle device and automatically evaluated. An extension of the sender list can also be done using a message, e.g. SMS. If a sender identifier or sender telephone number is not stored in the ETCS vehicle device, a message from this sender in this scenario is not recognized as valid. Under some circumstances an error message can be issued or the message from a sender that is invalid in this way can be entirely suppressed.

The functionality presented here can be employed in all places to which the message, e.g. as SMS, can be sent and received.

A further option is that train data, Level and Mode can be automatically or semi-automatically derived from dispositive data and sent from a dispositive system (possibly also manually) to the ETCS vehicle device of the rail vehicle.

The approach presented here thereby makes it possible to transmit the train data, Level and Mode from a portable or stationary unit to the ETCS vehicle device of a rail vehicle. In this manner, previously necessary tasks of the traction vehicle driver can be transferred to other persons or from the location of the driver cab of the rail vehicle to other locations. By this means job sequences can be optimized and preparation times shortened.

FIG. 1 shows an exemplary scenario with a rail vehicle 101 with an ETCS device (also called ETCS vehicle device) comprising, among others, a computer 102, a wireless interface 103 and a driver-machine interface 104. The driver-machine interface 104 has means of input and output (a user interface) which enable a user, e.g. train driver, to interact with the computer 102.

In addition FIG. 1 shows a mobile unit 105, e.g. a smartphone or a laptop, in addition to a stationary unit 106, both of which have a connection to a network 107. The network 107 can be or can include, for example, a WLAN, a fixed network, a (mobile) telecommunications network or similar. By use of the network 107 the units 105, 106 can communicate with the rail vehicle 101, in particular transmit messages, e.g. in the form or one or more SMS, to the rail vehicle.

In addition a center 108 is provided that, for example, can receive messages from the units 105, 106. In addition the center 108 can transmit messages to the rail vehicle 101.

The center 108 is, by way of example, a computer or a computer network (that can also be arranged in a distributed manner). The center can be operated by an operator of the rail network or by a service provider.

The units 105, 106 can send messages, for example SMS messages, over the network 107 indirectly through the center 108 or directly to the rail vehicle 101. If a message is initially sent to the center 108, the center 108 can process this message, for example check its validity or content or complement it. The center 108 can, after processing the message, pass it onwards to the rail vehicle 101. In addition be it noted that the center 108 can itself also transmit a message to the rail vehicle 101.

The rail vehicle 101 receives the message via the wireless interface 103 and extracts ETCS data from the message (e.g. by means of the computer 102). The ETCS data can be checked, e.g. by means of a sender identifier and/or destination identifier contained in the message. The ETCS data can be entered as suggested values on the driver-machine interface 104, so that it only requires to be confirmed by a user, e.g. train driver. A tedious input procedure by the user himself is no longer required. Alternatively or additionally it is possible to use the ETCS data from the message to set up the rail vehicle. After successful receipt and/or checking of the ETCS data the status "Start Of Mission" can be reached in the rail vehicle 101, and the rail vehicle 101 is thus ready to carry out the next journey.

Figure 2:
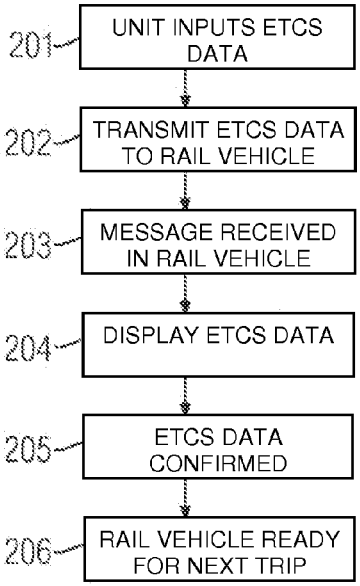
FIG. 2 an exemplary schematic flow chart with steps of the method presented here for inputting ETCS data into a rail vehicle.

FIG. 2 shows an exemplary schematic flow chart with steps of the method presented here for inputting ETCS data into a rail vehicle.

In a step 201 the inputting of the ETCS data is done by means of a unit, e.g. a portable computer, a smartphone or a stationary terminal. In a step 202 the ETCS data is transmitted to the rail vehicle in the form of a message. Such a transmission can in some circumstances also be done via a center (see above embodiments).

In a step 203 the message is received in the rail vehicle and there follows optionally a check of the ETCS data contained in the message. By way of example in the context of such a check further data of the message, e.g. a sender identifier and/or a destination identifier can be taken in to account.

In a step 204 the ETCS data values are displayed as suggested values on a user interface of the driver-machine interface of the rail vehicle. The ETCS data can also be directly used for setting up the ETCS device of the rail vehicle.

In a step 205 the ETCS data is confirmed, e.g. by the train driver in the driver cab of the rail vehicle. The rail vehicle is then ready to carry out the next journey (step 206).

Although the invention was illustrated and described in detail by at least one exemplary embodiment, the invention is not limited to this and other variants can be derived from this by the person skilled in the art without departing from the protected scope of the invention.

LIST OF REFERENCE SIGNS

101 Rail vehicle
102 Computer of the rail vehicle (also designated ETCS computer or EVC)
103 Radio interface (e.g. GSM-R transmission device)
104 Driver-Machine Interface (DMI), input terminal
105 Mobile unit
106 Stationary unit
107 Network including, for example, a mobile telecommunications network, a fixed network, a WLAN and/or the Internet.
108 Center
201-206 Steps of a method for the input of ETCS data into a rail vehicle

The invention claimed is:

1. A method for inputting train control system data into a rail vehicle, the method comprising the following steps:
capturing the train control system data by a unit, wherein the unit is selected from the group consisting of a mobile computer, a tablet personal computer, a smartphone, and a stationary computer;
transmitting the train control system data from the unit to an interface of the rail vehicle;
displaying the transmitted train control system data on an input terminal of the rail vehicle as preselected data values; and
accepting the train control system data displayed as preselected data in the rail vehicle as soon as the train control system data have been received and checked by the train control system with an option for confirmation of the train control system data by the user.

2. The method according to claim 1, which further comprises providing the train control system data with at least one of the following items of information:
train data,
a train control system Level, or
a train control system Mode.

3. The method according to claim 2, which further comprises providing the train data with at least one of the following items of information:
a maximum speed of the rail vehicle,
a length of the rail vehicle, or
a brake power of the rail vehicle.

4. The method according to claim 2, wherein the unit is the mobile computer, the tablet personal computer, or the smartphone.

5. The method according to claim 1, wherein the unit is the stationary computer.

6. The method according to claim 5, wherein the stationary computer is an operator terminal.

7. The method according to claim 1, which further comprises carrying out the step of transmitting the train control system data to the interface of the control system device of the rail vehicle by using at least one message.

8. The method according to claim 7, which further comprises providing the at least one message as an SMS message.

9. The method according to claim 7, which further comprises providing the at least one message as at least one of a sender identifier or a destination identifier.

10. The method according to claim 9, wherein:

the sender identifier is a telephone number;

valid sender identifiers are stored in the rail vehicle; and the stored sender identifiers are used in checking if the sender identifier of a message is valid.

11. The method according to claim 1, wherein the interface is selected from the group consisting of a wireless interface, a wired interface, and a combination of a wireless interface and a wired interface.

12. The method according to claim 1, which further comprises performing the step of transmitting the train control system data from the unit to the interface of the control system device of the rail vehicle by transmitting at least a portion of the train control system data from the unit to a center and then from the center to the interface of the control system device of the rail vehicle, wherein the center is selected from the group consisting of a computer and a computer network.

13. The method according to claim 1, which further comprises determining the train control system data at least partially automatically from dispositive data from vehicle operation and transmitting the train control system data to the interface of the control system device of the rail vehicle.

14. A rail vehicle, comprising:

a train control system device including:

an interface configured for receiving train control system data; and an input terminal configured for displaying the received train control system data as preselected data values;

wherein the train control system device is configured for accepting the train control system data displayed as preselected data on the input terminal as soon as the train control system data have been received and checked by the train control system with an option for confirmation of the train control system data by the user.

15. The rail vehicle according to claim 14, wherein the train control system device is configured for using the confirmation of the train control system data by the user as a prerequisite for an ability of the rail vehicle to carry out a subsequent journey.

16. The method according to claim 1, which further comprises using the confirmation of the train control system data by the user as a prerequisite for an ability of the rail vehicle to carry out a subsequent journey.

* * * * *